US006332384B1

(12) United States Patent
Cluthe

(10) Patent No.: US 6,332,384 B1
(45) Date of Patent: Dec. 25, 2001

(54) MULTIPLE BIT SCREWDRIVER

(76) Inventor: Gary Paul Cluthe, 302 Whitmore Drive, Waterloo (CA), N2K 2N5

( * ) Notice: Subject to any disclaimer, the term of this patent is extended or adjusted under 35 U.S.C. 154(b) by 0 days.

(21) Appl. No.: 09/779,520

(22) Filed: Feb. 9, 2001

(51) Int. Cl.[7] ..... B25G 1/08
(52) U.S. Cl. ..... 81/490; 81/439
(58) Field of Search ..... 81/490, 437, 439, 81/440, 177.4, 177.85

(56) References Cited

U.S. PATENT DOCUMENTS

| | | | | |
|---|---|---|---|---|
| 2,629,413 | * | 2/1953 | Stettler | 81/490 |
| 2,635,661 | * | 4/1953 | Egan | 81/490 |
| 3,006,395 | * | 10/1961 | Dye | 81/177.4 |
| 3,750,729 | | 8/1973 | Lemieux . | |
| 4,716,795 | * | 1/1988 | Corona et al. | 81/490 |
| 4,762,036 | * | 8/1988 | Orlitzky et al. | 81/177.4 |
| 4,768,405 | * | 9/1988 | Nickipuck | 81/177.85 |
| 5,325,745 | | 7/1994 | Koehler . | |
| 5,337,637 | | 8/1994 | Bih-Lien . | |
| 5,526,721 | | 6/1996 | Waisvisz . | |
| 5,673,600 | * | 10/1997 | Yanagi et al. | 81/490 |
| 5,813,296 | * | 9/1998 | Hoff et al. | 81/177.85 |
| 6,205,893 | * | 3/2001 | Sato | 81/490 |

* cited by examiner

*Primary Examiner*—James G. Smith
*Assistant Examiner*—Hadi Shakeri
(74) *Attorney, Agent, or Firm*—R. Craig Armstrong

(57) ABSTRACT

A multiple bit screwdriver having an elongated housing with a plurality of longitudinal channels, each channel having a longitudinal slot opening the channel to an outer surface of the housing. A plurality of screwdriver bits are slidably arranged one in each channel. A plurality of elongated sliding means are arranged one in each channel to reciprocally slide the bit between a retracted position and an extended position. The sliding means are pivotably attached to the bit and has a manipulation means protruding from the channel via the slot. Further, a bit clamping unit is securely attached to a forward end of the screwdriver. The bits may protrude through a central through hole in the clamping unit when in the extended position. The clamping unit has a plurality of locking elements arranged in cutouts, and a sleeve arranged to reciprocally slide over the clamping unit between a forward position and a rearward position biased by a spring towards the forward position. The sleeve clamps the locking elements to lock the bit when in the extended position and frees the locking elements when the sleeve is in the rearward position, to allow the bit to be slid to the retracted position inside the screwdriver.

8 Claims, 8 Drawing Sheets

MULTIPLE BIT SCREWDRIVER

BACKGROUND OF THE INVENTION

1. Field of the Invention

The invention relates to a screwdriver having multiple bits selectable for use one at the time and the bits being stored inside a handle of the screwdriver.

2. Description of the Prior Art

In the past, different approaches have been tried to provide screwdrivers having a plurality of bits accessibly stored in a housing of the screwdriver, the housing generally also serving as the screwdriver gripping handle.

U.S. Pat. No. 3,750,729 (Lemieux) shows a multiple driver tool having a chamber for holding a plurality of screw drivers. Each driver has a guided slide, by means of which the driver can be selectively moved to a passage extending away from an end of the chamber. Guide means in the chamber directs each driver towards and into the passage during movement of that driver. Each driver is long enough, that when in the passage, it projects beyond the end of the tool. Each driver is attached to a flexible actuator, which can be used to slide the driver from a stored position, inside the tool, to an extended position, where the tip of the driver protrudes outside the tool. In the extended position, wings arranged at the sides of the driver engage slots in the tool housing, to provide a torque transfer from the tool to the driver. Simultaneously, the driver is held in the extended position by a spring biased pin latch engaging a groove in the driver. The user of the tool has to release the pin latch, by pressing a lever disengaging the pin latch from the groove, to slide the driver back into the retracted position. The drivers (bits) are required to have the specially shaped groove (with a stepped surface to catch on the pin latch) and the torque transfer wings, making it necessary to manufacture drivers that are non-standard and therefor more expensive. The latch mechanism, with its lever operated latch pin, is also seemingly fragile.

U.S. Pat. No. 5,325,745 (Koehler) shows a hollow screwdriver housing with a handle portion at the rear of the housing. The front of the housing is open and individual screwdriver bits are slidable back and forth from a stored position angularly located inside the housing in a retracted position, to a in-use position where a hexagonal end of the screwdriver bit is held by a central column attached to the handle and where the working tip of the screwdriver bit extends outside the housing. Each bit has an actuator attached to it, the actuator extending through an opening in the housing. The bit may be moved from a storage position inside the handle by pressing the pre-selected actuator, moving the bit outside of the open end of the housing, holding the actuator down and retracting the bit to engage a recess of the central column. The substantially long-reaching bit is held by the recess only, for both torque transfer and lateral support. The actuator attaches substantially to the middle of the bit, to provide a small amount of additional lateral support. If any side-ways pressure is applied on the bit, by the user exerting force via the handle, it seems apparent that the bit according to this construction lacks sufficient lateral support for high-torque applications. Since substantially long-reaching bits are used, the space requirements inside the handle are large, and to provide a suitably well-anchored central column, the length of the handle is also large. The end result is a tool of substantial length.

SUMMARY OF THE INVENTION

It is an object of the invention to provide an improved multi-bit screwdriver, which overcomes all or most of the apparent drawbacks associated with the cited prior art.

In the invention, a multiple bit screwdriver is described, having an elongated housing with a plurality of longitudinal channels, each channel having a longitudinal slot opening the channel to an outer surface of the housing. A plurality of screwdriver bits are slidably arranged one in each channel, each bit having a working end and an attachment end. A plurality of elongated sliding means are arranged in each channel to reciprocally slide the bit between a retracted position and an extended position. The sliding means have a first end and a second end, the first end being pivotably attached to the attachment end of one of the plurality of bits, the second end having a manipulation means protruding from the channel via the slot. Further, a bit clamping unit, having a chamber communicating with a central through hole of a forward portion of the clamping unit, is arranged at a forward end of the screwdriver. The clamping unit is securely attached to the housing, the bits protruding through the central through hole in the extended position. The clamping unit has at least one radially extending cutout connecting the central through hole with an external surface of the forward portion of the clamping unit, a plurality of locking elements arranged in each cutout, and a sleeve arranged to reciprocally slide over the forward portion of the clamping unit between a forward position and a rearward position biased by a spring towards the forward position. The sleeve has a forward end and a rearward end, the forward end having a retaining ridge cooperating with retaining means arranged on the clamping unit to prevent the sleeve from being removed. The forward end has a sloping recess aligned with the cutouts to apply pressure on the locking elements in the forward position of the sleeve, to clamp the bit when in the extended position and to free the locking elements when the sleeve is in the rearward position, to allow the bit to be slid to the retracted position.

Preferably, there are three of locking elements.

Preferably, there are six screwdriver bits.

Advantageously, the screwdriver further has an end cap securely attached to the housing at a side opposite the bit clamping unit.

The bit clamping unit preferably has guide recesses arranged on an inside of the chamber to form a guide path directing the bits into the central through hole.

The manipulation means is preferably arranged on an outer arm of the second end and has a dish held by a stem protruding from the channel via the slot, so that the dish is slidable in the longitudinal recess.

The second end preferably has a lower arm with a heel arranged on a side facing inwards when the second end is inserted in the channel, for cooperation with the channel, so that when the sliding means is in the retracted position the heel protrudes radially out from the channel holding the sliding means in position.

BRIEF DESCRIPTION OF THE DRAWINGS

In order that the invention may be more clearly understood, the preferred embodiment thereof will now be described in detail by way of example, with reference to the accompanying drawings, in which.

DETAILED DESCRIPTION OF THE INVENTION

Figure 9:
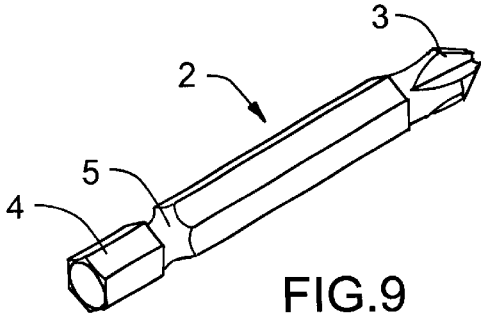
FIG. 9 is a schematic elevational side view of a screwdriver bit as used in the multiple bit screwdriver according to the invention.
Figure 6A:
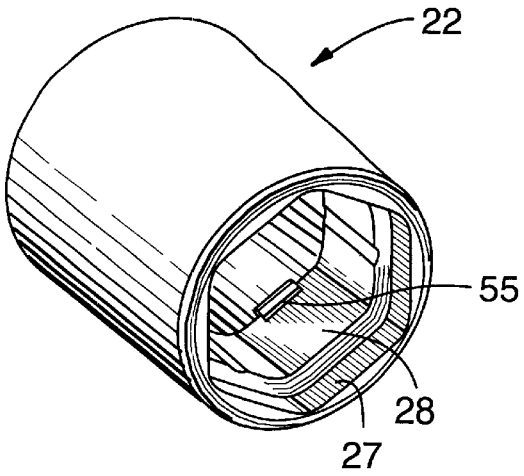
FIG. 6A is a schematic elevational side view of a sleeve of the multiple bit screwdriver according to the invention.
Figure 6B:
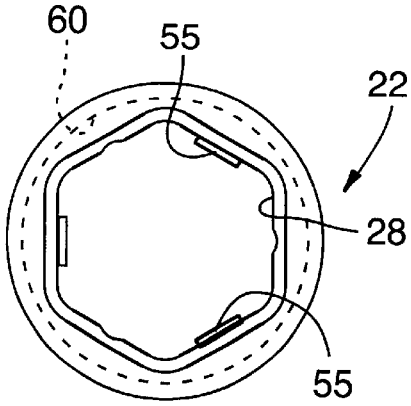
FIG. 6B is a front view of the sleeve of FIG. 6A.
Figure 6C:
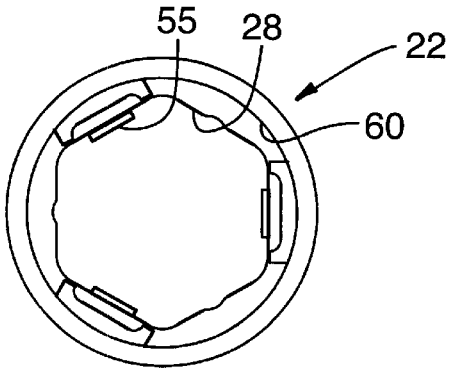
FIG. 6C is a rear view of the sleeve of FIG. 6A.

A multiple bit screwdriver 1 according to the invention is shown in FIGS. 1A to 8B. As shown in FIGS. 1A, 1B, 1C, 8A and 8B, the screwdriver has an elongated housing 19 having a plurality of internal longitudinal channels 29, each channel having a longitudinal slot 31' opening the channel to an outer surface of the housing. A longitudinal recess 31 runs on both sides of the longitudinal slot. A plurality of screwdriver bits 2 are slidably arranged one in each channel. Each bit has a working end 3 and an attachment end 4, with an annular retention groove 5 (as shown in FIG. 9). The bits are of a standard type readily available. A plurality of elongated sliding means 10, having a first end 11 and a second end 13 are arranged in each channel 29 to reciprocally slide the bit 2 between a retracted position and an extended position.

Figure 1A:
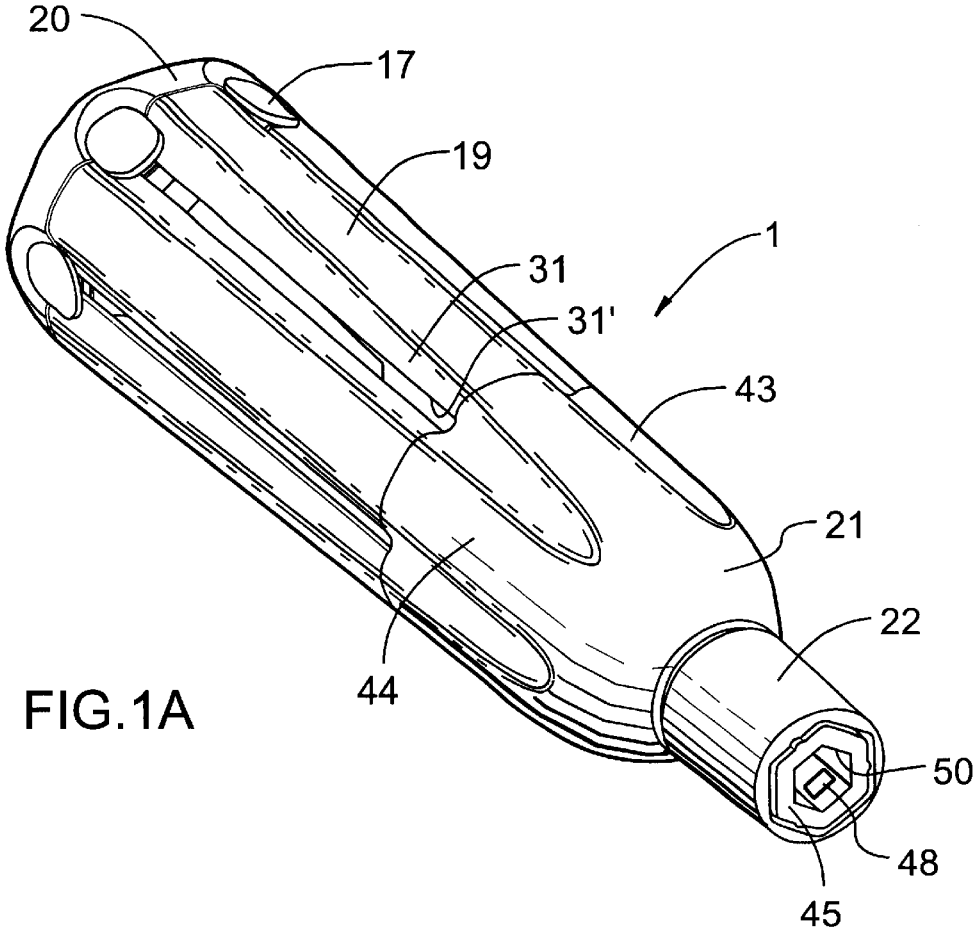
FIG. 1A is a schematic elevational side view of a multiple bit screwdriver according to the invention, showing all bits in their retracted positions.
Figure 1B:
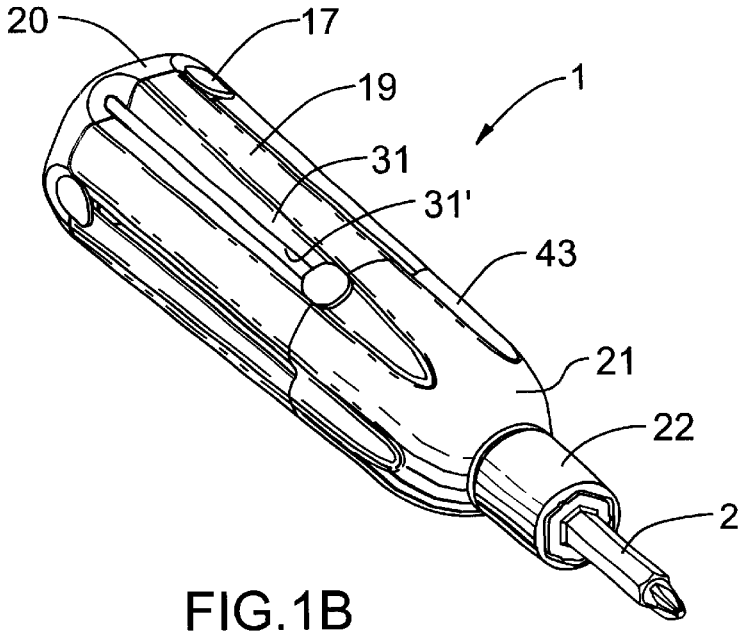
FIG. 1B is a schematic elevational side view of the multiple bit screwdriver of FIG. 1A, showing one bit in its extended position.
Figure 1C:
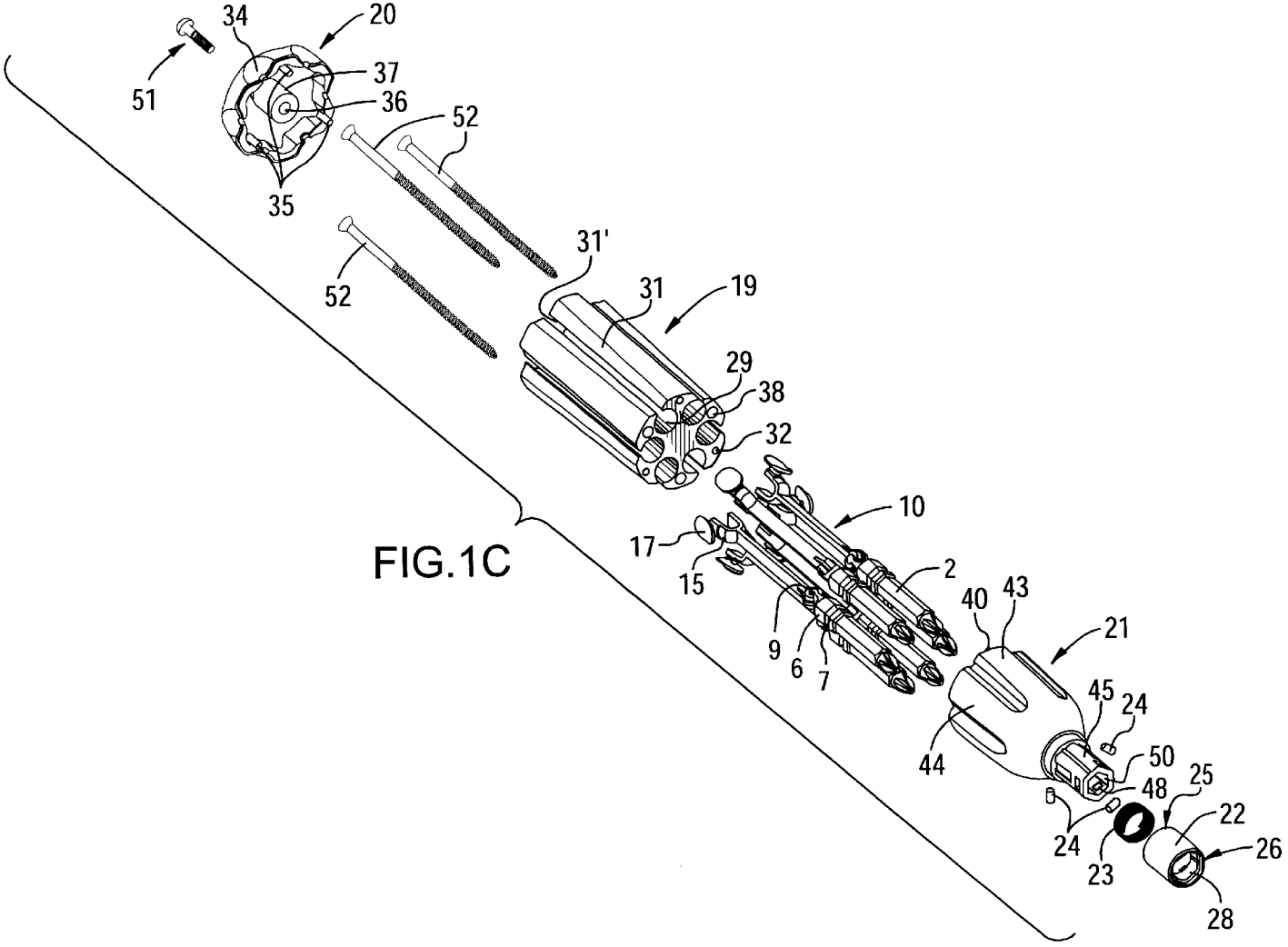
FIG. 1C is a schematic exploded elevational side view of the multiple bit screwdriver of FIG. 1A.
Figure 2A:
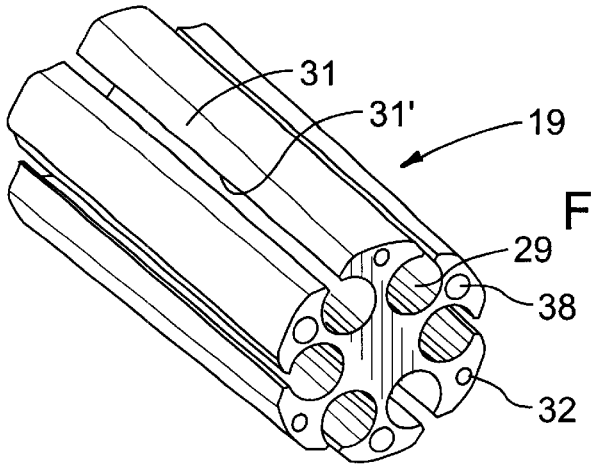
FIG. 2A is a schematic elevational side view of a housing of the multiple bit screwdriver according to the invention.
Figure 2B:
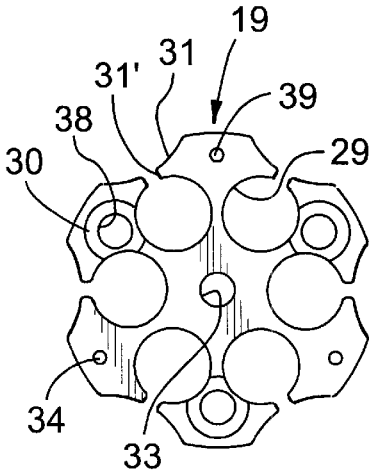
FIG. 2B is a schematic rear view of the housing of FIG. 2A.
Figure 2C:
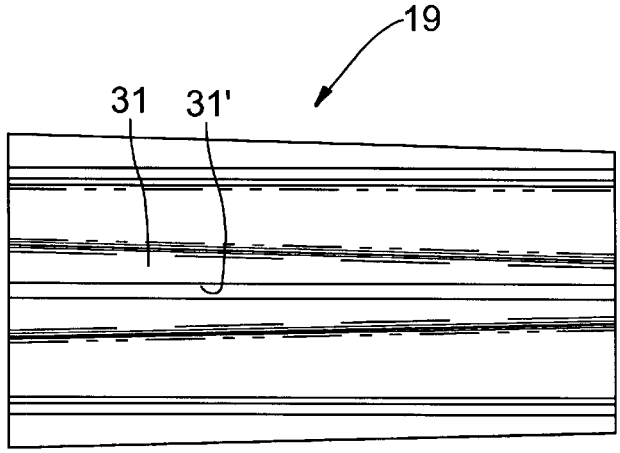
FIG. 2C is a schematic side view of the housing of FIG. 2A.
Figure 2D:
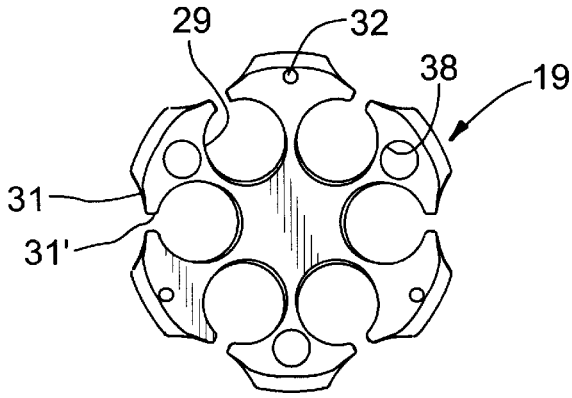
FIG. 2D is a schematic front view of the housing of FIG. 2A.
Figure 3A:
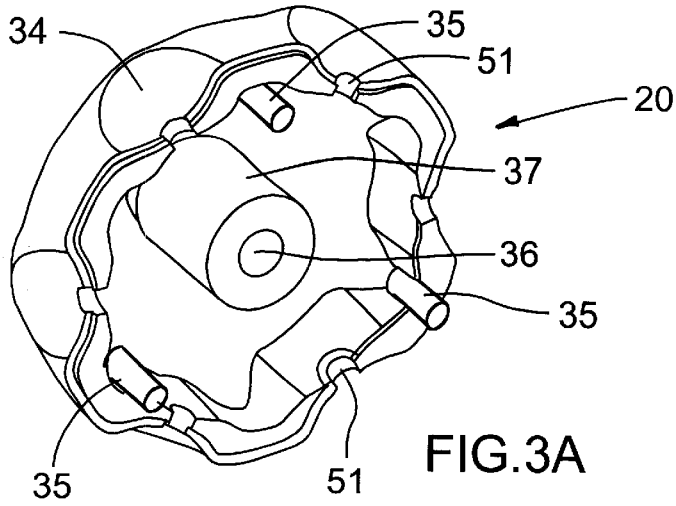
FIG. 3A is a schematic elevational side view of an end cap of the multiple bit screwdriver according to the invention.
Figure 3B:
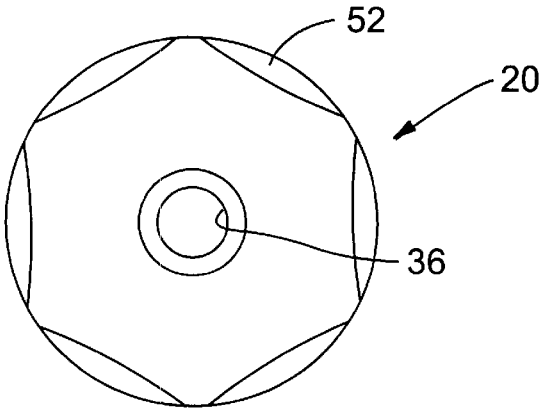
FIG. 3B is a schematic rear view of the end cap of FIG. 3A.
Figure 3C:
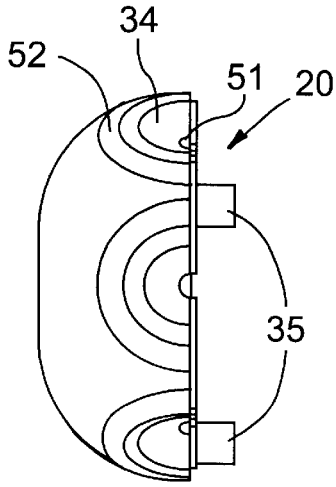
FIG. 3C is a schematic side view of the end cap of FIG. 3A.
Figure 3D:
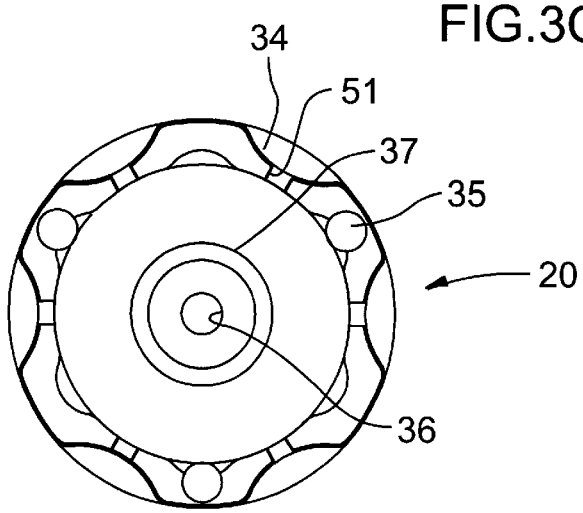
FIG. 3D is a schematic front view of the end cap of FIG. 3A.
Figure 4A:
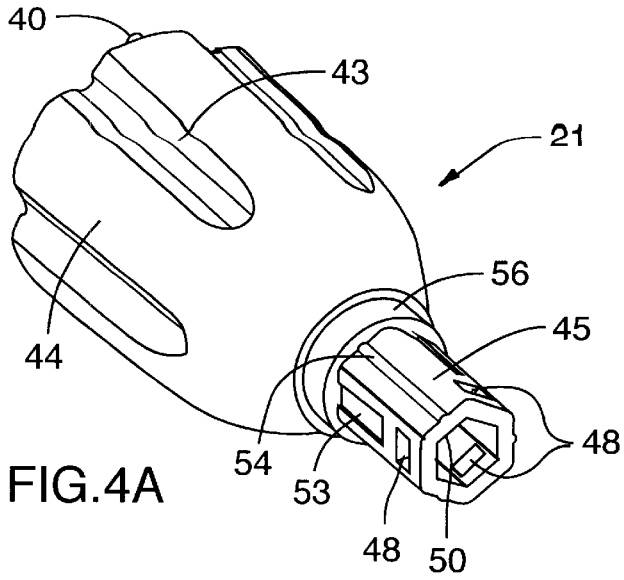
FIG. 4A is a schematic elevational side view of a clamping unit of the multiple bit screwdriver according to the invention.
Figure 4B:
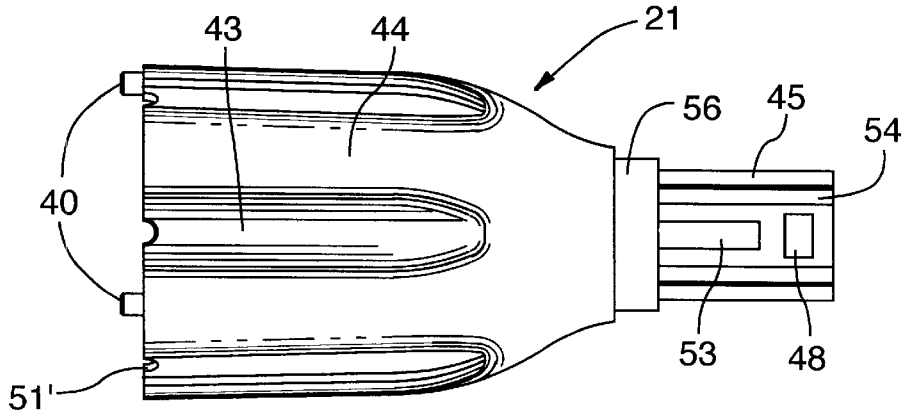
FIG. 4B is a schematic rear view of the clamping unit of FIG. 4A.
Figure 4C:
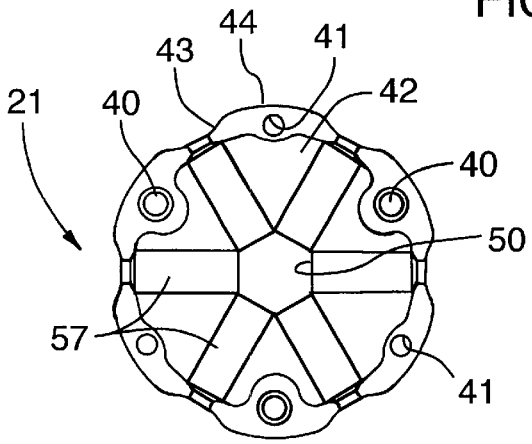
FIG. 4C is a schematic side view of the clamping unit of FIG. 4A.
Figure 4D:
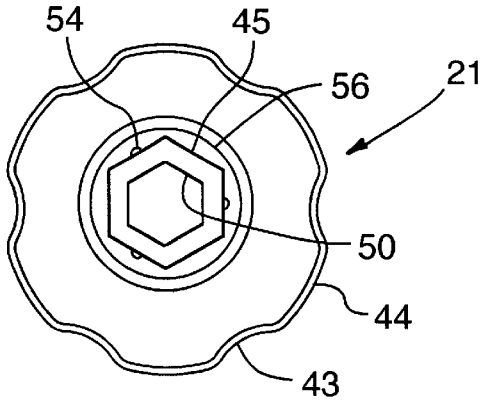
FIG. 4D is a schematic front view of the clamping unit of FIG. 4A.
Figure 5A:
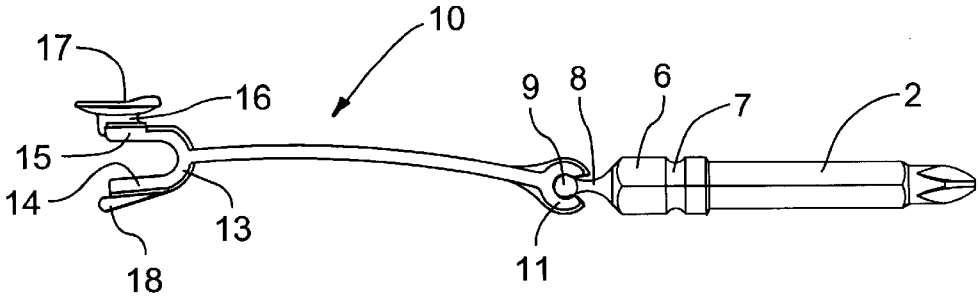
FIG. 5A is a schematic side view of a sliding means and a screwdriver bit having a coupling device according to the invention.
Figure 5B:
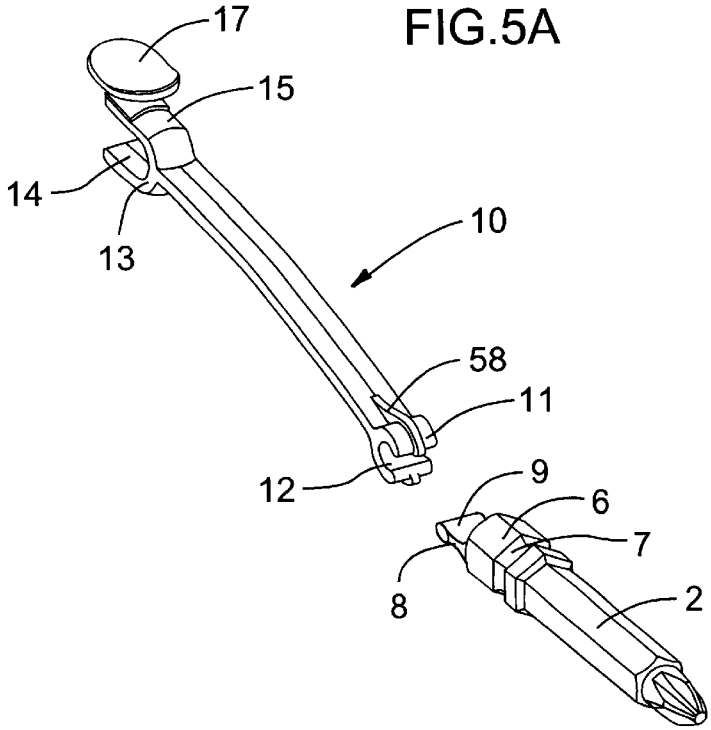
FIG. 5B is a schematic elevational side view of the sliding means and the screwdriver bit having a coupling device of FIG. 5A.

The first end 11 is attached to the attachment end 4 of one of the bits via a clamping attachment 6, which attaches to the attachment end of the bit, for example by being cast directly over the attachment end (see FIGS. 5A and 5B). The clamping attachment has a groove portion 7, which conforms generally to the annular retention groove 5 shape of the bit, making it possible to still lock the bit using a locking means (which will be described in detail later), and a protruding shaft portion 8 which ends in a substantially rod-shaped pivot attachment 9. The first end 11 preferably has a substantially C-shaped pivot fork having an inner surface 12 substantially corresponding to an outer surface of the pivot attachment 9. When the first end is assembled onto the pivot attachment, the pivot fork flexes and snaps around the pivot attachment, permitting a pivotal movement of the attachment end 4 of the bit 2 relative the sliding means 10. The first end advantageously has reinforcement ridges 58, to strengthen the C-shaped fork.

The second end 13 has a manipulation means 16,17 preferably a substantially flat or slightly concave dish 16 held by a stem 17, which protrudes from the channel 29 via the slot 31. The manipulation means is arranged on an outer arm 15 of the second end, whilst a lower arm 14 has a heel 18 arranged on a side facing inwards when the sliding means 10 is inserted in the channel. The dish 16 of the manipulation means slides in the longitudinal recess 31.

The screwdriver 1 further has a bit clamping unit 21, having a chamber 42 communicating with a central through hole 50 of a forward portion 45 of the clamping unit. The clamping unit is securely attachable to the housing 19, for instance via long screws 52 arranged in screw through holes 38 of the housing and cooperating with mounting holes 41 of the clamping unit. The bits 2 protrude through the central through hole 50 when in their extended position to allow the working end 3 to be used for driving a screw. The clamping unit further has at least one radially extending cutout 48 connecting the central through hole with an external surface of the forward portion 45 of the clamping unit 21. A plurality of locking elements 24, preferably cylindrical to allow the locking elements to absorb a greater force during operation of the screwdriver, are arranged one in each cutout, but prevented from entering fully through the cutouts by the cutouts having a narrowing cross-section close to the central through hole 50.

Figure 7A:
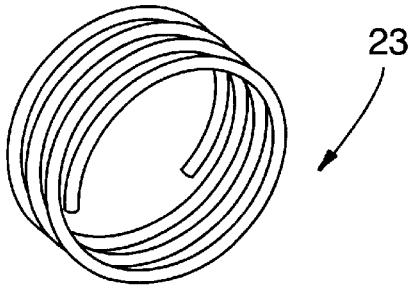
FIG. 7A is a schematic elevational side view of a biasing means of the multiple bit screwdriver according to the invention.
Figure 7B:
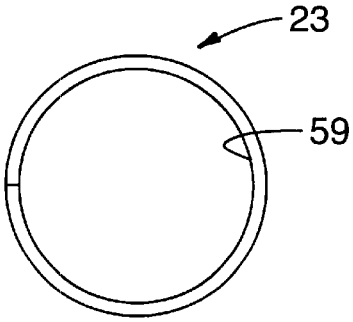
FIG. 7B is an end view of the biasing means of FIG. 7A.
Figure 7C:
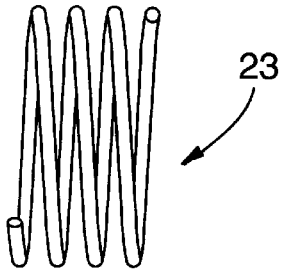
FIG. 7C is a side view of the biasing means of FIG. 7A.

A sleeve 22, having an smallest inner dimension 28 slightly larger than an outer dimension of the forward portion 45 of the clamping unit 21, is arranged to reciprocally slide over the forward portion, between a forward position and a rearward position, biased by a biasing means 23, preferably a spring as shown in FIGS. 7A to 7C, towards the forward position. The biasing means has an inner diameter 59, which allows the biasing means to slide on the forward portion 45 of the clamping unit 21. The sleeve has a forward end 26 and a rearward end 25, the forward end having at least one retaining ridge 55 cooperating with retaining slots 53 arranged on the forward portion of the clamping unit, to prevent the sleeve from being removed from the forward portion. When the sleeve is assembled onto the forward portion of the clamping unit, the retaining ridges and the side wall of the sleeve flex outwards so that the retaining ridges can slide over the forward position until they reach the retaining slots and flex back. The retaining slots run backward along the forward portion to a collar portion 56 of the forward portion, permitting the retaining ridges to travel unhindered when the sleeve is moved backwards. The collar has a diameter slightly smaller than an inside diameter 60 of the rearward end 25 of the sleeve 22.

The forward end 26 has a sloping recess 27, sloping from the smallest inner cross-section 28 of the sleeve 22 to a larger cross-section closer to the forward end. The smallest diameter cross-section is located directly above the locking elements when the sleeve is biased forwards, blocking any movement of the locking elements out of the cutouts 48. The larger diameter cross-section will be located directly above the locking elements when the sleeve is retracted backwards and allows the locking elements 24 to move out of the cutouts 48, thus the sleeve applies pressure on the locking elements in the forward position of the sleeve to clamp the bit 2 when in the extended position and frees the locking elements when the sleeve is in the rearward position, to allow the bit to be slid to the retracted position.

The clamping unit 21 further has first alignment pegs 40 for cooperation with first peg mounting holes 32 arranged in the housing at an end thereof adjacent the clamping unit. Alternatively, the alignment pegs may, of course, be arranged on the housing and the alignment holes be arranged on the end cap, or a combination.

FIGS. 3A to 3D show an end cap 20, which attaches to the housing 19, preferably via a short screw 52' arranged in a mounting hole 36 of a central boss 37 of the end cap. The short screw cooperates with a central mounting hole 33 of the housing. The end cap further has second alignment pegs 35 for cooperation with second peg mounting holes 39 arranged in the housing at an end thereof adjacent the end cap. Alternatively, the alignment pegs may, of course, be arranged on the housing and the alignment holes be arranged on the end cap, or a combination. Preferably, the end cap has convex protrusions 52 arranged rearward of recess 34, the end recesses on the end cap 20 corresponding in location and shape to the longitudinal recesses 31 of the housing.

Figure 8A:
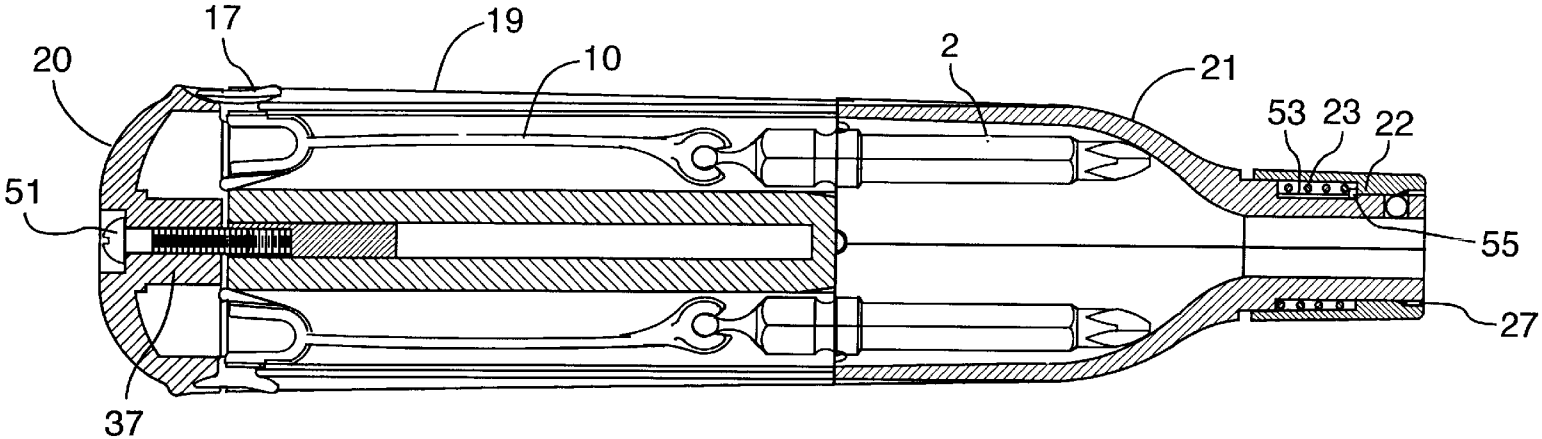
FIG. 8A is a schematic sectioned side view of the multiple bit screwdriver of FIG. 1A.
Figure 8B:
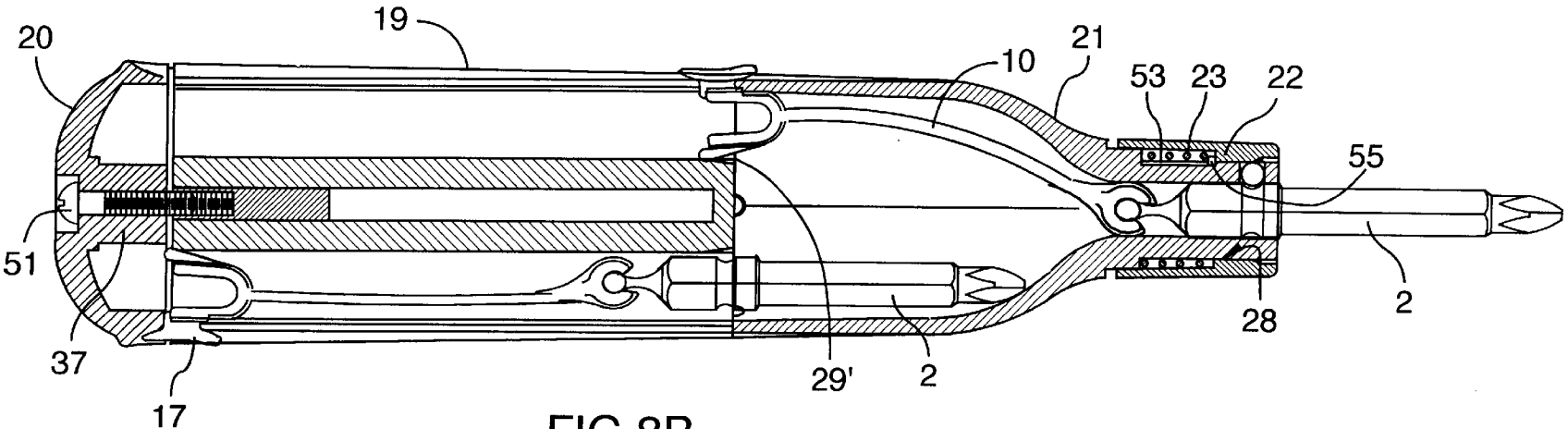
FIG. 8B is a schematic sectioned side view of the multiple bit screwdriver of FIG. 1B.

As is shown in FIGS. 8A and 8B, the sliding elements 10 slide in the channels 29 between a retracted position (FIG. 8A), where the screwdriver bit 2 is completely inside the screwdriver 1, and an extended position (FIG. 8B), where the working end 3 of the screwdriver bit is outside the screwdriver and the bit is securely held by the locking elements 24 engaging the groove portion 7 of the clamping unit 21, and the locking elements being pressed down by the sleeve 22, as described earlier. A user would push down with a finger on the stem 17 of the manipulation means and simultaneously push forwards, to slide a sliding means 10 with its attached bit 2. The bit would hit the inside of the chamber 42 and preferably be steered towards the central through hole 50 by guide recesses 57 arranged on the inside of the chamber to form a guide path directing the bit into the central hole. The sleeve 22 is held in its forward position by the biasing means 23, blocking the locking elements from movement, necessitating the sleeve to be pulled back to its rearward position to release the locking elements so that the bit 2 can pass fully out into the central through hole. The length of the sliding means 10 is chosen so that, when the bit is fully extended into the clamping unit's central through hole and locked in place by the locking elements, the stem 17 of the manipulation means is located in a forward position in the longitudinal slot 31' and abuts a relief 51' arranged in the clamping unit 21. Each channel 29 preferably has an enlarged cross-section portion 29' arranged at a forward end of the channels, to facilitate the movement and insertion of the sliding means 10 and the bit 2 in and into the channel.

To release and retract the bit 2 from its extended position, the sleeve 22 is pulled back against the biasing force of the biasing means to release the locking elements, as described earlier. The user can then slide the stem 17 back to its fully retracted position in the longitudinal slot 31', where the heel 18 preferably will allow the lower arm 14 of the second end 13 to flex downwards, because the radius of the end cap boss 37 is smaller than the distance from the bottom of a channel 29 to a central longitudinal axis of the housing (not shown).

An important feature of the multiple bit screwdriver according to the invention is the use of hexagonal cross-section standard bits spaced apart in 60 degree increments inside the handle, thus allowing a total of six bits. The bits are readily available in numerous profiles, making them both cheap and extremely versatile. The bit clamping unit having a hex hole necessitates the configuration with six bits in the screwdriver. Each bit is thus aligned with its flat sides in generally the same planes as the hex hole in the clamping unit, when the bits are in their retracted position inside the handle. When the bit is slid out towards the clamping unit, no twisting motion has to be applied to make the bit enter the hole of the clamping unit, making it possible to provide a rigid sliding means with a pivoting connection to the bit. If a twisting motion would be required for alignment, for instance if fewer bits than six were used and spaced apart more than in 60 degree increments or if more bits than six were used and spaced apart less than in 60 degree increments, the sliding means and/or the connection with the bit would have to be made resilient enough to allow the twisting motion, thus making the sliding action during retraction/extension of the bit much less precise. This would cause an uncertainly with the user as to the position of the bit within the handle and could possibly fault the function of the screwdriver due to breakage of the sliding means or the connection between the sliding means and the bit, the durability of the mechanism would be compromised compared to the mechanism used in the invention.

It will be appreciated that the above description relates to the preferred embodiments by way of example only. Many variations on the invention will be obvious to those knowledgeable in the field, and such obvious variations are within the scope of the invention as described and claimed, whether or not expressly described.

What is claimed is:

1. A multiple bit screwdriver, comprising:

an elongated housing having a plurality of longitudinal channels, each said channel having a longitudinal slot opening said channel to an outer surface of said housing;

a plurality of screwdriver bits slidably arranged one in each said channel, each bit having a working end and an attachment end; and a plurality of elongated sliding means having a first end and a second end, said first end being pivotably attached to said attachment end of one of said plurality of bits, one said sliding means arranged in each said channel to reciprocally slide said one of said plurality of bits between a retracted position and an extended position, said second end of said sliding means having a manipulation means protruding from said channel via said slot, a bit clamping unit, having a chamber communicating with a central through hole of a forward portion of said clamping unit, said clamping unit being securely attached to said housing, said bits protruding through said central through hole in said extended position, said clamping unit comprising:

at least one radially extending cutout connecting said central through hole with an external surface of said forward portion of said clamping unit;

a plurality of locking elements arranged one in each said at least one cutout;

a sleeve arranged to reciprocally slide over said forward portion of said clamping unit between a forward position and a rearward position biased by a spring towards said forward position, said sleeve having a forward end and a rearward end, said sleeve having at least one retaining ridge cooperating with retaining means arranged on said forward portion of said clamping unit to prevent said sleeve from being removed from said forward portion, and said forward end having a sloping recess aligned with said cutouts to apply pressure on said locking elements in the forward position of said sleeve, to clamp said bit when in said extended position and to free said locking elements when said sleeve is in said rearward position, to allow said bit to be slid to said retracted position.

2. The multiple bit screwdriver as recited in claim 1, wherein there are three of said plurality of locking elements.

3. The multiple bit screwdriver as recited in claim 1, wherein there are six screwdriver bits.

4. The multiple bit screwdriver as recited in claim 2, wherein there are six screwdriver bits.

5. The multiple bit screwdriver as recited in claim 4, wherein said screwdriver further comprises an end cap securely attached to said housing at a side opposite said bit clamping unit.

6. The multiple bit screwdriver as recited in claim 5, wherein said bit clamping unit has guide recesses arranged on an inside of said chamber to form a guide path directing said bits into said central through hole.

7. The multiple bit screwdriver as recited in claim 1, wherein said manipulation means is arranged on an outer arm of said second end and has a dish held by a stem protruding from said channel via said slot, so that said dish is slidable in said longitudinal recess.

8. The multiple bit screwdriver as recited in claim 1, wherein said second end has a lower arm with a heel arranged on a side facing inwards when said second end is inserted in said channel, for cooperation with said channel, so that when said plurality of elongated sliding means are in said retracted position said heel protrudes radially out from said channel holding said plurality of sliding means in position.

* * * * *